US007510192B2

(12) United States Patent
Hansen

(10) Patent No.: US 7,510,192 B2
(45) Date of Patent: Mar. 31, 2009

(54) ACE UP POKER GAME

(76) Inventor: Brian Scott Hansen, 15988 W. 65th Pl., Arvada, CO (US) 80007

( * ) Notice: Subject to any disclaimer, the term of this patent is extended or adjusted under 35 U.S.C. 154(b) by 0 days.

(21) Appl. No.: 11/648,227

(22) Filed: Jan. 3, 2007

(65) Prior Publication Data

US 2008/0161085 A1 Jul. 3, 2008

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 5,486,005 | A | 1/1996 | Neal | |
| 5,489,101 | A * | 2/1996 | Moody | 273/292 |
| 5,531,448 | A * | 7/1996 | Moody | 273/292 |
| 5,722,661 | A * | 3/1998 | Skratulia et al. | 273/292 |
| 5,921,550 | A | 7/1999 | Awada | |
| 5,988,643 | A | 11/1999 | Awada | |
| 6,206,780 | B1 | 3/2001 | Awada | |
| 6,311,979 | B1 * | 11/2001 | Andrews | 273/292 |
| 6,332,614 | B1 * | 12/2001 | Hesse | 273/292 |
| 6,467,771 | B1 * | 10/2002 | deKeller | 273/274 |
| 6,478,675 | B1 | 11/2002 | Awada | |
| 6,511,068 | B1 * | 1/2003 | Sklansky et al. | 273/237 |
| 6,705,943 | B2 | 3/2004 | Awada | |
| 6,986,514 | B2 * | 1/2006 | Snow | 273/292 |
| 7,029,011 | B2 * | 4/2006 | Strong et al. | 273/292 |
| 7,264,243 | B2 * | 9/2007 | Yoseloff et al. | 273/292 |
| 2002/0113317 | A1 | 8/2002 | Snow | |

OTHER PUBLICATIONS

Scarne's Enclycopedia Of Games, John Scarnes.*

* cited by examiner

*Primary Examiner*—Gene Kim
*Assistant Examiner*—Dolores Collins
(74) *Attorney, Agent, or Firm*—Barber Legal; Craig Barber

(57) ABSTRACT

A poker game with physical cards or on an electronic gaming device may be played in which the aces are promoted up a payout schedule so as to provide greater payout than aces normally are accorded based upon pure statistical likelihood of the ace hand occurring. Multiple rounds of poker play against a pay table may be carried out, with the rounds progressing from one card to a defined number of cards such as 5 or 7, with wagers on each or some rounds. A single card poker hand pay schedule may be used, with the Ace of Spaces accorded a larger payout than other aces, and three community cards may be used to speed play at a table with multiple players playing against the modified pay table.

3 Claims, 5 Drawing Sheets

ACE UP POKER GAME

FIELD OF THE INVENTION

This invention relates generally to casino games, and specifically to modified poker game mechanics and pay-off schedules.

CROSS-REFERENCE TO RELATED APPLICATIONS

N/A

STATEMENT REGARDING FEDERALLY FUNDED RESEARCH

This invention was not made under contract with an agency of the US Government, nor by any agency of the US Government.

BACKGROUND OF THE INVENTION

A number of poker games with pay schedules are known. Searching in the collection of the United States Patent and Trademark Office reveals various types of such games.

U.S. patent Pub. No. 2002/0113371 teaches a card game in which the players are offered multiple rounds of wagering. U.S. patent Pub. No. 2002/0137558 is another such, as are U.S. Patent Pub. Nos. 2003/0038425, 2003/0042679, 2004/0061288, 2004/0090005, 2004/0183256, 2004/0219970 and U.S. Pat. Nos. 5,288,081, 5,975,529, 6,206,780, 6,478,675, 6,705,943, 6,817,614, and 6,840,517.)

Other US patents offer alterations to the straightforward poker rules known. U.S. Pat. Nos. 5,486,005, 5,531,448, 5,921,550, 5,988,643, 6,626,433, 6,805,353, and 6,811,153.

Alterations include the "Super 9" game (U.S. Pat. No. 5,921,550) in which the "9" card is of particular interest or games which combine elements of multiple older games (U.S. Pat. No. 5,988,643).

There are even a small number of games which offer two or three rounds of poker style play against a pay table, such as a five card and seven card hand in one play, or a "3-5-7" card play or the like. (U.S. Pat. Nos. 6,206,780, 6,478,675, and 6,705,943).

However, none of these games offer a poker hand pay schedule modified so that aces are moved up the table, the aces up being worth at least as much as any other poker hand, even statistically less likely hands.

In addition no known games offers a poker pay schedule for a single card poker hand with the Ace of Spades valued more highly than any other card.

In addition, no known games offer the opportunity for multiple rounds of play based upon a single additional card beginning from one card and using three community cards.

SUMMARY OF THE INVENTION

General Summary

The present invention teaches that a poker game with physical cards or on an electronic gaming device may be played in which the aces are promoted up a payout schedule so as to provide greater payout than aces normally are accorded based upon pure statistical likelihood of the ace hand occurring. The present invention further teaches that multiple rounds of poker play against a pay table may be carried out, with the rounds progressing from one card to a defined number of cards such as 5 or 7, with wagers on each or some rounds. A single card poker hand pay schedule may be used, with the Ace of Spaces accorded a larger payout than other aces, and three community cards may be used to speed play at a table with multiple players playing against the modified pay table.

Summary in Reference to Claims

It is therefore a first aspect, advantage, objective and embodiment of the invention to provide a method of playing an improved casino poker game having a schedule of payouts to players based upon acquisition of certain hands in a hand of X cards, wherein the improvement comprises:

assigning a highest payout of the schedule to a hand having X aces.

It is therefore a second aspect, advantage, objective and embodiment of the invention to provide a method of playing an improved casino wherein X is one member selected from the group consisting of: one card, two cards, and four cards.

It is therefore another aspect, advantage, objective and embodiment of the invention to provide a method of playing an improved casino poker game wherein X is one and further wherein the highest payout of the schedule is to a hand having the Ace of a specific suit.

It is therefore another aspect, advantage, objective and embodiment of the invention to provide a method of playing an improved casino poker game wherein the specific suit is spades.

It is therefore another aspect, advantage, objective and embodiment of the invention to provide a method of playing a casino poker game having a schedule of payouts to players based upon acquisition of certain hands in a hand of X cards, wherein the improvement comprises providing a modified payout schedule for values of X where X is one member selected from the group consisting of: 1 card, 2 cards, and 4 cards.

It is therefore another aspect, advantage, objective and embodiment of the invention to provide a method of playing a casino poker game comprising the following steps:

a) setting a value of N=one, where N is a value of the number of rounds played in the poker hand, b) dealing out to each player an increment of I cards so as to form a poker hand of I*N cards;

c) after each increment of I cards are dealt, comparing the cards in each player's hand to a poker payout schedule specialized for poker hands of I*N cards;

d) incrementing N by one;

e) repeating steps b) through d) for a total of Y rounds of play;

where Y is a value of at least four total rounds of play and I is a value of at least one card.

It is therefore another aspect, advantage, objective and embodiment of the invention to provide a method of playing a casino poker game wherein:

Y is five and I is one; and further wherein;

the poker payout schedule optimized for hands having I*N cards pays the highest payout to a hand having I*N aces.

It is therefore another aspect, advantage, objective and embodiment of the invention to provide a method of playing a casino poker game wherein:

Y is five and I is one; and further wherein;

the poker payout schedule optimized for hands of I*N cards includes at least one payout selected from the group consisting of: I*N card flushes, I*N card straights, and combinations thereof.

INDEX OF REFERENCE NUMERALS

Figure 1:
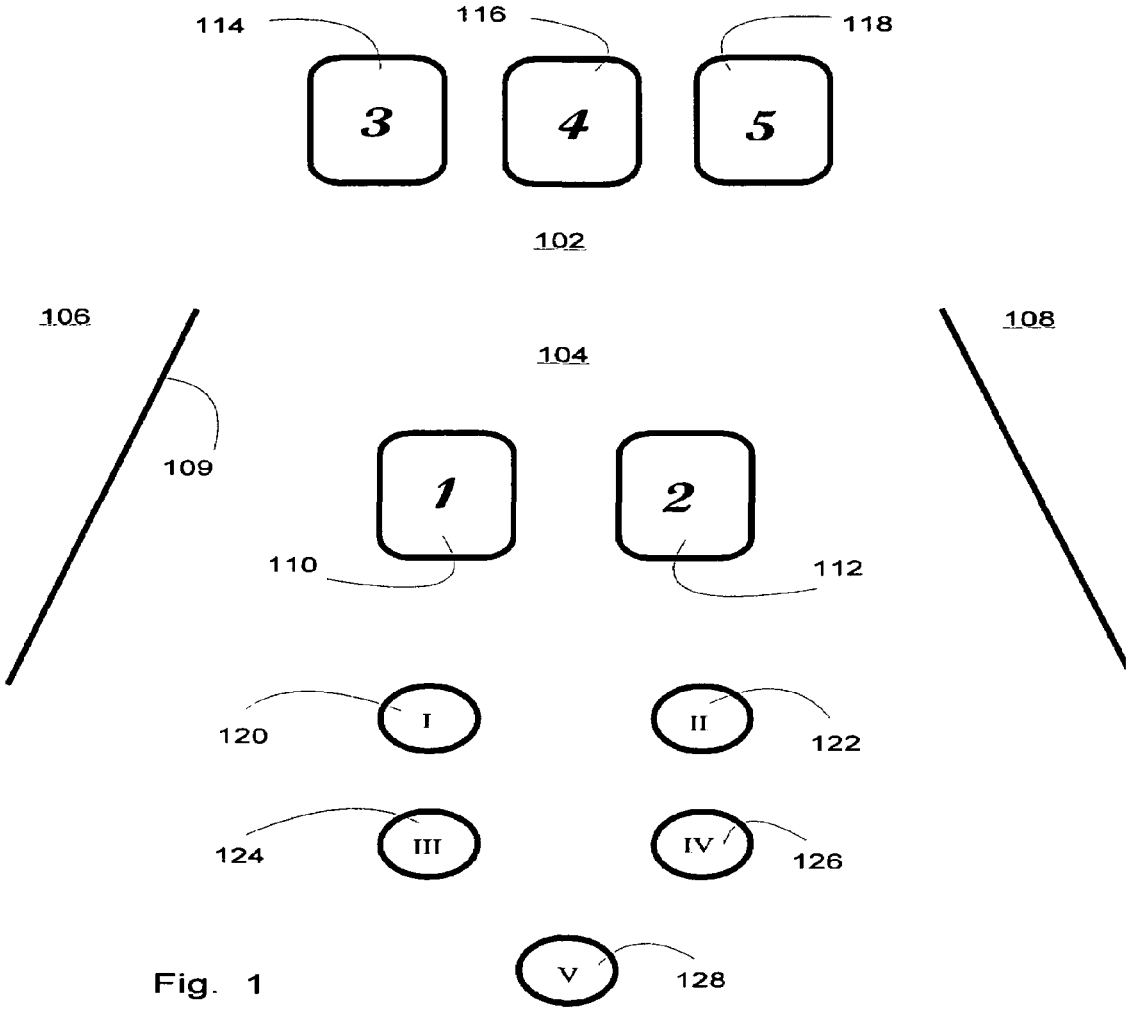
FIG. 1 is a partial planform view of a first game mat embodiment of the invention.

Dealer area 102
First player area 104
Second player area 106
Third player area 108
First card/card location 110
Second card/card location 112
Third card/card location 114
Fourth card/card location 116
Fifth card/card location 118
First wager location 120
Second wager location 122
Third wager location 124
Fourth wager location 126
Fifth wager location 128
First card (revealed)/location 202
Second card location 204
Credits bet by card location 206
Indication of credits bet 208
Betting control 210
Individual card deal control 212
Deal control 214
Place wagers 302
Deal 304
First card wager payout 306
Second card wager payout 308
Third card wager payout 310
Fourth card wager payout 312
Fifth card wager payout 314
Placement of bets 401
Start N value 402
Deal I cards 404
I card wager payout 406
Add I cards 408
Repeat 410

DETAILED DESCRIPTION

FIG. 1 is a partial planform view of a first game mat embodiment of the invention. The mat is divided into a dealer area and a number of player areas. Dealer area 102 has the usual accouterments of a dealer's station at a gaming table: a place to set the shoe, places for tips and so on. (Not shown). It also has spaces to deal out three community cards 114, 116, 118.

A number of player areas 104, 106, 108 and so on are arranged in a semi-circle around the dealer area. First player area 104 has first card/card location 110 and second card/card location 112. During the deal, the dealer will deal out two cards, one to each location, and will repeat the process for every player area which is in use around the table, thus providing each player with two cards. The three community cards 114, 116, 118 will be available for use by all players in constructing a five card poker hand.

Prior to the deal, players will place wagers on at least one of five wager locations: first wager location 120, second wager location 122, third wager location 124, fourth wager location 126 and fifth wager location 128. Each wager location corresponds to one round of play during the hand.

In play, the cards are compared to a poker hand payout schedule beginning with a single card hand, and the player's wager is either collected if the player lost or winnings are paid out if the player won. The wager, however, is limited to the amount bet for a specific number of cards. So if a player wins on the first card, only the wager at location 120 is used to calculate the amount of the payout. If the player loses on the first card, only the wager at location 120 is lost.

Thus it may be seen that a number of rounds of play occur in the course of a single hand of the "schedule poker".

Figure 2A:
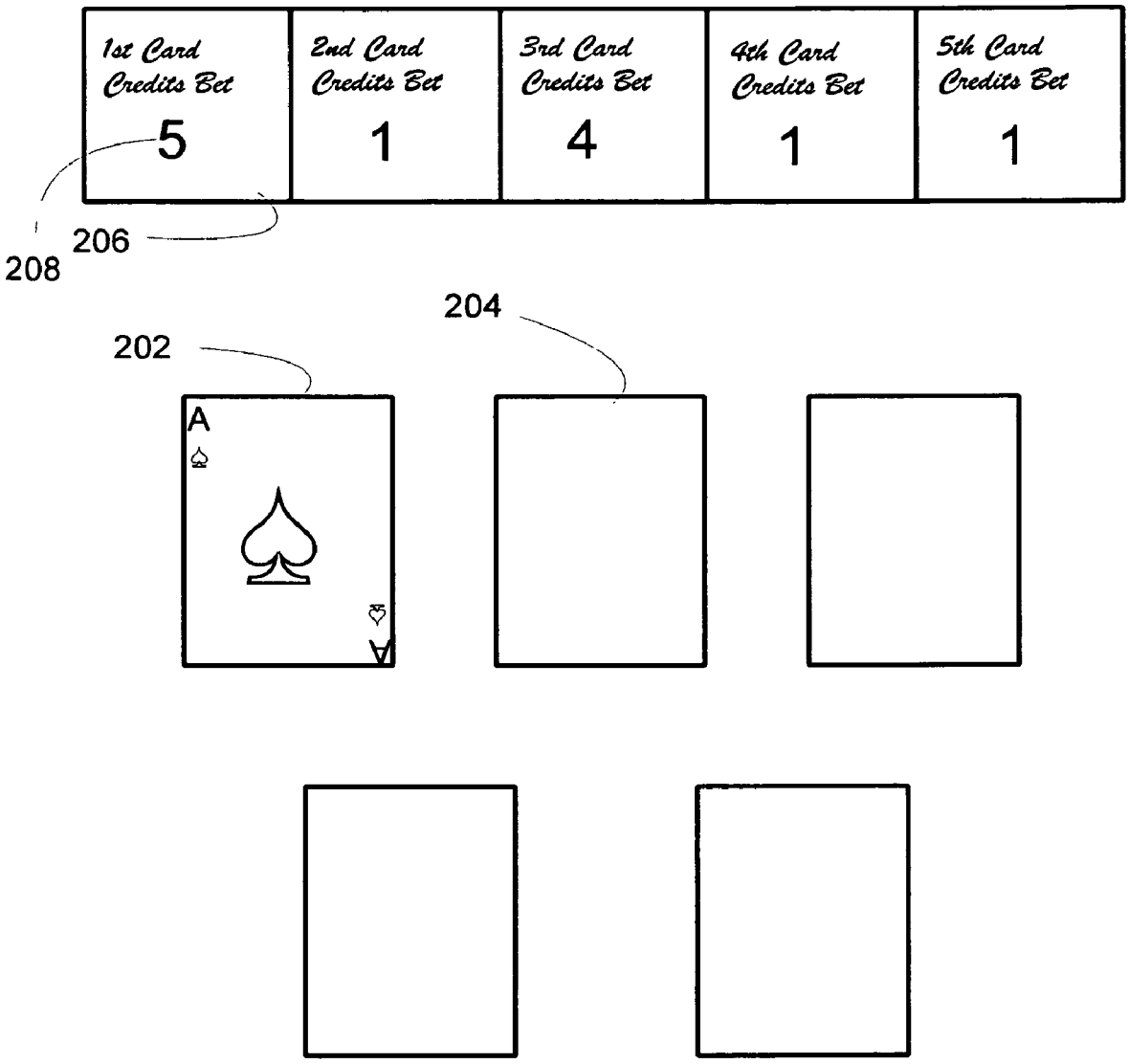
FIG. 2*a* is a partial planform view of a second video embodiment of the invention, showing the screen.
Figure 2B:
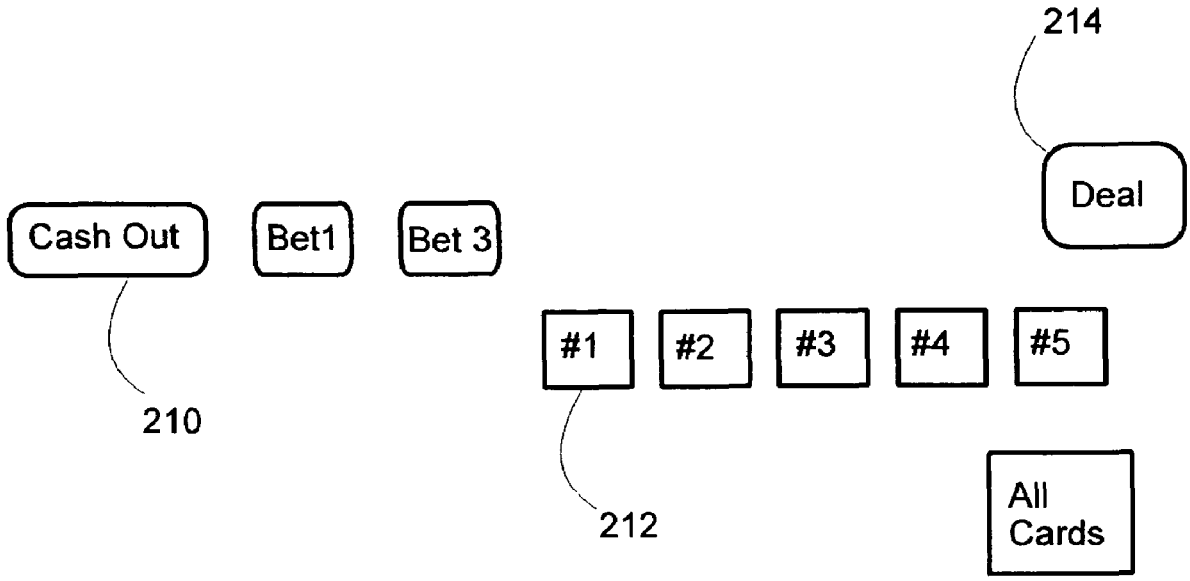
FIG. 2*b* is a partial planform view of a button board of the second embodiment.

FIG. 2*a* is a partial planform view of a second video embodiment of the invention, showing the screen, while FIG. 2*b* is a partial planform view of a button board of the second embodiment.

The game need not be limited to play at a table, it may also be played at a gaming machine programmed to act as a dealer and display cards for the player. First card (revealed)/location 202 may show the player the first card (as depicted) after that card is revealed. Second card location 204 and others have not yet been revealed, and may be blank or may depict a "back of the card" pattern.

Credits bet by card location 206 allows the player to place a bet on each card of their hand, while indication of credits bet 208 indicates the exact amount of each such bet, for example, the player has bet 5 credits on card one.

FIG. 2*b* shows betting control 210 and individual card deal control 212 as well as deal control 214. Using betting control 210 or another button, the player may place bets, for example, "Bet I", "Bet all", "Bet max", "Bet 5", etc.

Individual card control 212 may be used to control card 1, either to indicate the card on which a given bet will be placed or to reveal or deal the card, etc.

Deal controls may allow dealing of the cards, which in embodiments may occur in one round, two rounds, or any number of rounds up to the number of the cards played.

It will be appreciated that the controls shown are exemplary, a wide range of controls may be utilized instead of buttons, or the buttons may be arranged in other ways, all within the scope of the present invention.

Figure 3:
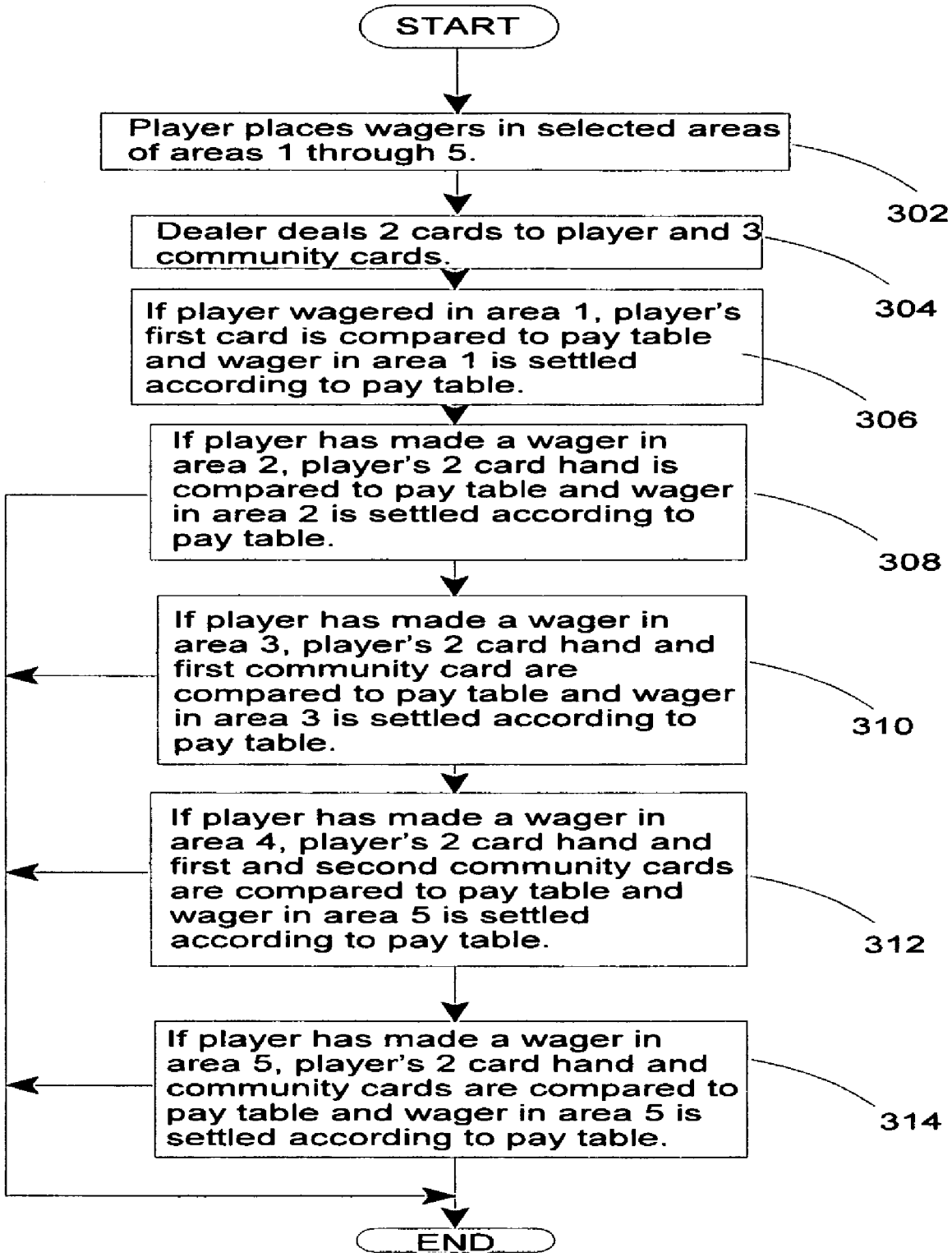
FIG. 3 is a flow chart of a third method of play embodiment of the present invention.

FIG. 3 is a flow chart of a third method of play embodiment of the present invention. This outlines the course of play of the game. At the commencement of a single hand, the players place bets in selected ones of the wager areas 1 through 5 (step 302). A player may bet only on area 1, or only on areas 1 and 2, or any other combination of the areas. In alternative embodiments of the game, the player's wagers may be limited to sequential numbers of cards (so that a player could play area 1, or areas 1 and 2, or 1, 2, 3, or 1, 2, 3, 4, or all five, but the player could not skip any one of the wagers in the sequence, for example by betting only on the fifth hand), the wagers may be limited in scope, may ride from one area to the next in the event of a win, and so on. However, in the most general embodiment, the players simply place wagers on one or more of the wager areas before the deal.

In the next step (step 304) the dealer or dealing machine will deal out two cards to each player and three community cards. In a machine embodiment having only a single user, or at a table play embodiment in which play by only one player is occurring or is allowed to occur, the three community cards are used only by the single player, in addition to the two cards specifically dealt to that player, to form a series of poker hands ranging from one card to five. However, in normal player (with more than one player) all players use the three community cards equally in forming the poker hands, while each player uses only their own two cards in forming the poker hands.

In alternative embodiments, certain cards may be "up" (dealt with the face of the card visible to all onlookers, players, etc) and/or certain cards may be dealt hidden. In embodiments, players may or may not be allowed to examine their hidden cards. In the presently preferred embodiment, the first card dealt to each player is dealt up and all other cards (the second player card and the three community cards) are dealt out hidden from view.

In the third step (306) one particular card from each player is compared to a single card poker hand pay table and the result of the wager is determined and the wager is lost to the casino or the payout is made to the player. In the presently preferred embodiment, the first card used is the player's first card as this option may offer the highest level of excitement and diverse player results, but in alternative embodiments some other one of the five cards may be used, including one of the community cards.

In the fourth step, step number 308, two of the cards are compared to a two card poker hand pay schedule and the result of the wager is determined and settled. In the best mode now contemplated, the player's two card hand is used, but in other embodiments, two of the community cards or one community card and one player card are used. At the present time, it is preferred that the single card used for the first round (see step 306 above) be used in all subsequent rounds of the hand, but in alternative embodiments, a card might be used in step 306, then two other cards used in step 308, then the first card used again in some later round of wagers, and so on. In general, the simplest approach and thus the most satisfying for game play seems to be to "build" the hand: from a one card hand to a two card hand using the first card, then adding a third card to the three already used, and so on. In FIG. 1, it will be noted that the card placement areas 110, 112, 114, 116, 118 are provided with convenient indicia to indicate the order in which the cards are added to the hand.

The rules of which of the five total cards are used at which round, however, are subject to a wide range of alternative embodiments without departing from the scope of the invention claimed.

At step 310, the player uses a three card hand compared to a three card poker hand payout schedule or pay table (for example, by combining the player's two card hand with a first one of the three community cards), at step 312, a four card hand is compared and at step 314, a five card hand is played. In embodiments in which certain cards are hidden, the cards may be exposed at the time that the card is used for the wager. That is, if the fifth card (location 118) is dealt down, it may remain hidden until the determination and settlements at step 314, the five card hand.

In alternative embodiments, the play may start with a first number of cards "I", which may be one or may be some other number. Play may then proceed in rounds which add a certain number of cards "I" again, and again, through four or more rounds of play. In the examples of FIGS. 1 and 3, and in the preferred embodiment, "I" is a single card and play runs from 1 card to 5 cards. In other embodiments covered by the invention, play be run from 1 card to 7 cards by increments of a single card, or from 1 card hands to 7 card hands by increments of 2 cards (four rounds of play per hand), or other numbers until a limit of "Y" rounds of play is reached.

These steps may be carried out by dealer and player using physical cards, or they may be carried out by a machine.

Figure 4:
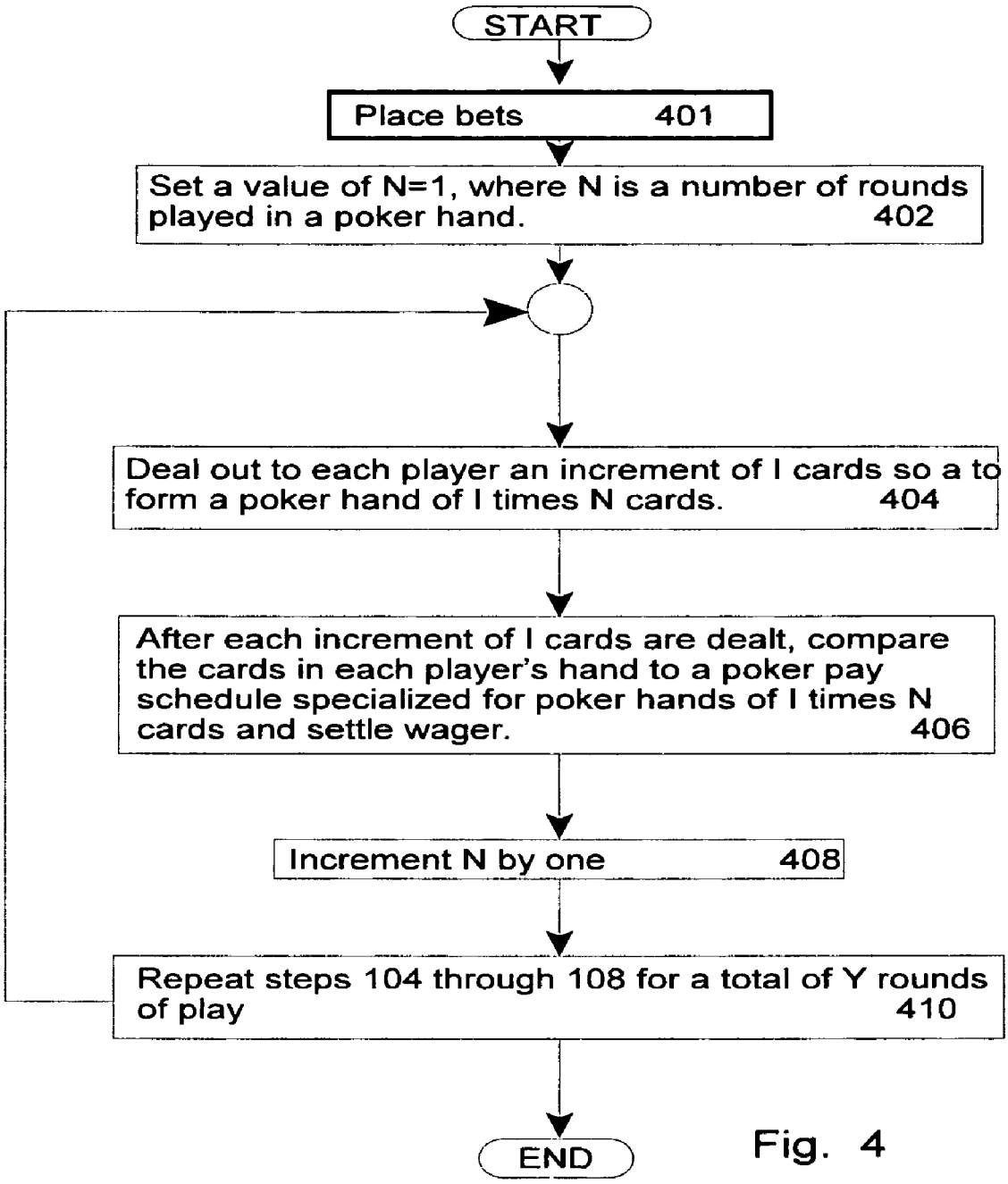
FIG. 4 is a flow chart of a fourth method of play embodiment of the present invention.

FIG. 4 is a flow chart of a fourth method of play embodiment of the present invention, in which the value of I starts at 1 and increments by 1 to a limit of 5, but in which the deal occurs one card at a time (rather than an initial deal followed by one by one examination of the cards). This embodiment provides more showmanship but takes longer for the dealer, a disadvantage in modern high-volume casinos.

Bets are placed (step 401), and the number of cards to play started a ONE or another start value (step 402), then cards dealt out in increments (step 404), comparisons to the pay table are made (step 406) and payouts made according to the table.

After each round is completed, the number of the cards is incremented by one, (step 408) that is, the dealer and player(s) will go from for example, 2 card hands up to 3 card hands, and at step 410, the process is repeated: a card is dealt out to go from 2 cards to 3 cards in each hand, comparisons made and so on.

All rules may of course be adjusted to form alternative embodiments which comply with local gaming regulations regarding pay tables, modes of dealing, and so on.

Various pay tables may be devised which allow the players to determine poker hands such as pairs, flushes, straights and so on with smaller numbers of cards than five.

In the presently preferred embodiment, the valuation of the various ace cards is moved up the pay table out of proportion to the absolute probability of achieving a certain number of aces versus that of achieving other less likely hands. The valuation of the Ace of Spades in particular may be further promoted.

Thus, even in embodiments in which multiple rounds of betting are not used at all, the game may provide a unique experience by offering pay tables which put the aces up the tables to the very top.

Examples of such tables are provided.

Table I shows a single card poker and pay out schedule. In this embodiment, the ace cards have the highest values, and the Ace of Spades in particular has the very highest value on the table.

TABLE I

| ONE CARD HAND | PAYOUT (RATIO TO WAGER) |
|---|---|
| ACE OF SPADES | 6 |
| ACE | 3 |
| K, Q, J, 10 | 1 |

Obviously, by adjusting payouts against the odds of achieving a certain hand, the payout table may be maintained in conformity with local regulations (Tables I through V all show pay out schedules which meet regulatory standards in at least one jurisdiction.)

The ratio to wager of the payout is only the ratio to the wager placed in the appropriate area for the single card hand. For example, in FIG. 1, the payout would be a ratio based upon the wager deposited prior to play at location 120 of the mat embodiment.

Table II shows a first possible two card payout schedule. As with Table I, the payout is based only on the wager for the two card hand, not for any wagers on other numbers of cards.

TABLE II

| TWO CARD HAND | PAYOUT (RATIO TO WAGER) |
|---|---|
| PAIR OF ACES | 14 |
| PAIR | 3 |
| TWO CARD STRAIGHT | 2 |
| FLUSH | 1.5 |
| A & Q | 1 |

Table IIA shows an alternative two card poker hand payout schedule. Again, the payout is dependent only on the amount placed for the second round of betting on the hand (location 122 in FIG. 1, for example), and again the valuations have been adjusted to promote aces up to the top the table.

TABLE IIA

| TWO CARD HAND | PAYOUT (RATIO TO WAGER) |
|---|---|
| PAIR OF ACES | 16 |
| PAIR | 4 |
| FLUSH | 1.5 |
| A & K, A & Q | 1 |

Table III is much like Tables I and II: payouts have been adjusted to make aces the favorable card in terms of probability and payout amount, the bet placed for the three card hand is the only one used in determining payout size, and so on.

TABLE III

| THREE CARD HAND | PAYOUT (RATIO TO WAGER) |
|---|---|
| THREE ACES | 80 |
| STRAIGHT FLUSH | 40 |
| THREE OF A KIND | 30 |
| STRAIGHT | 6 |
| PAIR OF ACES | 4 |
| FLUSH | 3 |
| PAIR | 1 |

Tables IV and V are similar to the tables previously discussed. Note that major and dramatic changes are made from the payouts which would normally be used based upon the pure probability of achieving a particular poker hand. For example, in a five card poker hand (see Table V) a royal flush is much less likely than four aces, but the adjustment of moving aces up to the top of the table requires the two payouts to be at least equal, despite the difference in odds.

TABLE IV

| FOUR CARD HAND | PAYOUT (RATIO TO WAGER) |
|---|---|
| FOUR ACES | 500 |
| FOUR OF A KIND | 150 |
| STRAIGHT FLUSH | 50 |
| THREE OF A KIND | 10 |
| STRAIGHT | 9 |
| FLUSH | 7 |
| TWO PAIRS | 5 |
| PAIR | 1 |

TABLE V

| | |
|---|---|
| ROYAL FLUSH | 400 |
| STRAIGHT FLUSH | 400 |
| FOUR ACES | 400 |
| FOUR OF A KIND | 175 |

TABLE V-continued

| | |
|---|---|
| FULL HOUSE | 50 |
| FLUSH | 25 |
| STRAIGHT | 10 |
| THREE OF A KIND | 8 |
| TWO PAIRS | 4 |
| PAIR OF 10'S OR BETTER | 1 |

In the presently preferred embodiment and best mode presently contemplated for carrying out the invention, the rules presented in TABLE SIX may be used.

Table Six (1) Ace Up Poker may be played only on tables displaying the Ace Up Poker table layout. A single deck of 52 cards will be used. Each player may play only one Ace Up Poker hand following each shuffle of the deck. Each hand of Ace Up Poker consists of five games. 1 card, 2 card, 3 card, 4 card and 5 card poker. Each hand of Ace Up Poker shall be complete after the dealer has settled all wagers made on the hand.

(2) Before receiving any cards, each player shall place a wager in the designated area on the layout. A player may wager on any 1, 2, 3, 4, or all 5 games in the hand. The amount of each wager shall be within the table limit, to be determined by the retail licensee and shall be posted at the table. A player, who wishes to tip the dealer by making a bet, must place a bet for the player and may place the tip-bet next to the players wager for that game. Each retail licensee may allow or may not allow tip-bets according to its policy. All tip-bets allowed shall be paid according to the posted pay schedule for player wagers.

(3) Prior to each round of play, the dealer shall shuffle and cut the cards. The dealer shall deal a total of 2 cards to players making a wager, the first card to the player is dealt face up and the second card face down and three community cards dealt face down to be used by all players using the following method:

(a) The dealer will deal a card face down into the designated area for the first community card to the dealer's left marked "3rd card". The dealer will then deal one card face up in the designated area marked "1 st card" of the player's position in a clockwise rotation from left to right to each player who has made a wager. The dealer will then deal a second community card face down into the appropriate position on the layout marked "4th card" and a second card face down in the designated area marked "2nd card" of the player's position. The final 3rd community card is dealt face down in the appropriate position on the layout marked "5th card", and the remainder of the deck is placed in the discard rack.

(4) If a shuffle device is used, the licensee shall have a second deck of cards at the table which are of a predominately different in color back. As one deck is being shuffled by the machine, the other deck is in use. The deck is alternated between hands. The dealer shall deliver cards from the shuffling device in groups of two, dealing them to the players face down with the top card designated as the first card and the bottom card designated as the second card. To set the community cards, the dealer places the group of two cards face down with the top card designated as the first community card and the bottom card designated as the second community card. The dealer places a second group of 2 cards on the table designating the top card as the 3rd community card and burning the bottom card. These three remaining cards are placed into the appropriate positions on the layout, constituting the community cards. After all cards are dealt, the dealer will expose the one card poker hand from right to left using the same pay and take procedures listed in paragraph 6.

(5) An incorrect number of cards dealt to any player constitute a misdeal for that player only. An incorrect amount of cards dealt to the dealer constitutes a misdeal for every player. All misdealt hands wagers are void and returned to the player and misdealt cards are picked up and placed in the discard rack. An exposed card does not constitute a misdeal. The dealer will turn the card over and continue to deal. An exposed community card will not constitute a misdeal. If a player's card falls from the table, that players hand is dead and that player's wager (s) is void. If a community card falls from the table, all hands are dead.

(6) After each player has received the players first two cards and the three community cards have been dealt face down. From right to left in a counter clockwise rotation, the dealer will settle each player's one card poker hand by collecting all non winning wagers and paying all winning wagers according to the posted one card pay schedule. The card used for the one card pay schedule will be the first card dealt to the player's hand and is designated as the first card position on the layout. If players have not placed a 2, 3, 4 or 5 card poker wager the dealer will place those players' two cards in the discard rack.

(a) Immediately after the dealer has settled all one card poker hands, the dealer will expose the second card of each players position and settle all two card poker hands by collecting all non winning wagers and paying all winning wagers according to the posted two card poker pay schedule; two card hands are designated as the first two cards the dealer deals to each players playing position and is designated on the layout as 1st card and 2nd card positions on the layout. If players have not placed a 3, 4 or 5 card poker wager, the dealer will place those players' two cards in the discard rack.

(b) After all 2 card poker payouts are settled. The dealer will expose the first community card, and settle all 3 card poker hands by collecting all non winning wagers and paying all winning wagers according to the posted 3 card pay schedule. The 3 card poker hand consists of the first two cards dealt to the player's hand and the first community card. If players have not placed a 4 or 5 card poker wager, the dealer will place those players' two cards in the discard rack.

(c) After all 3 card payouts are settled. The dealer will expose the 2nd community card marked 4th card, and settle all 4 card poker hands by collecting all non winning wagers and paying all wagers according to the posted 4-card poker pay schedule. The 4 card poker hand consists of the first two cards dealt to the player and the first and second community cards. If players have not placed a 5 card poker wager, the dealer will place those players' two cards in the discard rack.

(d) After all 4 card poker payouts are settled. The dealer will expose the third community card, and settle all 5 card poker hands by collecting all non winning wagers and paying all winning wagers according to the posted 5-card poker pay schedule. The 5 card poker hand consists of the first two cards dealt to the player and the 3 community cards.

(7) After all wagers have been paid, the dealer shall place the cards from all hands in the discard rack and reshuffle the deck for the next game.

End of Table Six

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A method of playing a casino poker game comprising the following steps:

a) setting a value of N=one, where N is a value of the number of rounds played in the poker hand, b) dealing out to each player an increment of I cards, where I is an integer number of cards, so as to form a poker hand of I*N cards;

c) after each increment of I cards are dealt, comparing the cards in each player's hand to a poker payout schedule specialized for poker hands of I*N cards and payout made according to the payout schedule;

d) incrementing N by one;

e) repeating steps b) through d) for a total of Y rounds of play;

where Y is a value of at least four total rounds of play and I is at least one card.

2. The method of playing a casino poker game of claim 1, wherein:

Y is five and I is one; and further wherein;

the poker payout schedule optimized for hands having I*N cards pays the highest payout to a hand having I*N aces.

3. The method of playing a casino poker game of claim 1, wherein:

Y is five and I is one; and further wherein;

the poker payout schedule optimized for hands of I*N cards includes at least one payout selected from the group consisting of: I*N card flushes, I*N card straights, and combinations thereof.

* * * * *